United States Patent [19]

Hassman

[11] 4,346,373

[45] Aug. 24, 1982

[54] INTRUSION WARNING SYSTEM UTILIZING A DIFFERENTIAL ELECTRIC FIELD

[76] Inventor: Gregory V. Hassman, 3126 Avis Way, Pinole, Calif. 94564

[21] Appl. No.: 138,404

[22] Filed: Apr. 8, 1980

[51] Int. Cl.[3] ..... G08B 13/26

[52] U.S. Cl. ..... 340/561; 340/564

[58] Field of Search ..... 340/561, 564, 552

[56] References Cited

U.S. PATENT DOCUMENTS

| | | | |
|---|---|---|---|
| 2,956,269 | 10/1960 | Schmidt | 340/564 |
| 4,064,499 | 12/1977 | Geiszler et al. | 340/564 |
| 4,174,518 | 11/1979 | Mongeon | 340/561 |
| 4,254,413 | 3/1981 | Mongeon | 340/561 |

*Primary Examiner*—Glen R. Swann, III

*Attorney, Agent, or Firm*—Spencer & Kaye

[57] ABSTRACT

A quasi-stationary electric field is produced by a field wire which is insulated from ground and extends along a portion of the perimeter to be protected substantially parallel to ground, and which is connected to the output of an oscillator producing an output signal whose wavelength is very long compared to the length of the field wire. The field is sensed by first and second field sensing wires which are insulated from ground and extend substantially parallel to the field wire, on opposite sides of same, which are equidistantly spaced from the field wire and from ground, and which are vertically displaced from the field wire. The changes in the electric field sensed by the sense wires are detected by respective first and second detectors which produce respective first and second electrical analog output signals corresponding to the changes.

These first and second electrical analog output signals are combined and processed to produce an output signal whenever neither of the first and second electrical analog output signals is equal to zero and the difference between the first and second analog output signals is greater than a given value, and this combined and processed output signal is used to produce an alarm.

9 Claims, 7 Drawing Figures

INTRUSION WARNING SYSTEM UTILIZING A DIFFERENTIAL ELECTRIC FIELD

BACKGROUND OF THE INVENTION

The present invention relates to an intrusion warning alarm system for sensing and indicating the presence of an intruder within a given area. More particularly, the present invention relates to an improved intrusion warning system of the type wherein the presence of an intruder within a given area is detected by determining changes caused in an electric field caused by the movement of the intruder.

The basic type of intrusion warning or detection system which responds to changes in an electrical field caused by an intruder, and to which the present invention relates, is disclosed in U.S. Pat. No. 3,237,105 issued Feb. 22nd, 1966 to Henry P. Kalmus, the subject matter which is incorporated herein by reference. According to the teachings of this patent, a transmitting electrode and a receiving electrode are positioned on opposite sides of an area to be protected, and a quasi-stationary electric field is produced within the area to be protected by supplying a signal at a frequency in the range of, for example, 5–100 KHz to the transmitting electrode. The receiving electrode is connected by an amplifier to an AM detector which detects the modulation of the received field signal caused by the movement of an intruder through the electric field between the transmitting and receiving electrodes, and the detected signals fed to a bandpass amplifier having a passband in the order of 2–20 Hz, thereby passing the low frequency component due to movement of an intruder in an area between the electrodes. This filter output signal is then fed to an indicating or alarm device to indicate the presence of an intruder.

While the system disclosed in this patent operates satisfactorily in principle, it is susceptible to a number of problems when attempting to utilize same in practical applications or to extend the range of the system so that it can be used to cover relatively large areas, thus requiring that the sensitivity and hence the gain, be increased. One primary problem in practical applications in such distance is that of false alarms caused, for example, by stray electric fields within the passband of the system, by transients resulting from relative movement of the electrodes and/or, particularly when such a system is used outdoors, by movement of animate or inanimate objects, for example, animals or large bushes, in an area adjacent to generate an electric field.

U.S. Pat. No. 4,064,499 issued Dec. 20th, 1977 to T. D. Geiszler et al, subject matter which is likewise incorporated herein by reference, describes an improved intrusion warning system of the basic type identified above wherein the susceptibility to false alarms is materially reduced, and wherein the versatility of the system with regard to its application is materially increased. According to the teachings of this patent, these advantages are achieved by various features or combination of features, for example, a more desirable frequency range for the generated field, improved filtering, and a need for the detected signal exceeding a given threshold value for a given period of time before an indication or alarm is initiated. Although this system operates very satisfactorily for many applications, it still is susceptible to false alarms from certain types of external signals and/or moving objects. Additionally, particularly when the intrusion warning system is being utilized for perimeter type protection, it is desirable to know the direction of the intrusion, i.e. whether or not the intruder is entering or leaving the area being protected, which information is not provided by the system according to the patent.

SUMMARY OF THE INVENTION

It is therefore an object of the present invention to provide a further improved intrusion warning system of the above-identified type wherein the susceptibility is further reduced.

It is a further object of the present invention to provide an improved warning system of the above-identified type which will provide an indication showing the direction of the intrusion.

According to the basic concept of the invention, a portion of the perimeter of a given area is protected against intrusion by a system utilizing two electric field sensing arrangements similar to that disclosed in the above-identified Geiszler et al patent which are illuminated by a common electric field and by proper analog processing of the signals from the two sensing arrangements. More specifically, the system according to the invention comprises a means for producing a quasi-stationary electric field including a field wire insulated from ground and extending along the portion of the perimeter of an area to be protected substantially parallel to ground and an oscillator circuit having its output connected to the field wire and producing an output signal whose wavelength is very long compared to the length of the field wire, first and second field sensing wires which are insulated from ground and extend along the portion of the perimeter substantially parallel to and vertically displaced from the field wire and with the two field sensing wires being disposed on opposite sides of the field wire and equidistantly spaced from same and from ground, first and second detector means connected to the first and second sensing wires respectively, for detecting changes in the electric field sensed by the sense wires and for producing first and second analog signals corresponding to the changes, a signal processing means for combining and multiplying the first and second analog output signal and for producing an output signal whenever neither of the first or second analog output signals is equal to zero and the difference between the first and second analog output signals is greater than a given value, and a circuit means responsive to an output signal from the signal processing means for producing an alarm.

According to one embodiment of the invention, the signal processing means produces an output signal $$V_O=K(|V_A|)(|V_B|)(|V_A-V_B|)$$

wherein K is a variable gain constant, $V_A$ is the first analog electrical output signal and $V_B$ is the second analog electrical output signal. According to a preferred embodiment of the invention, the signal processing means is provided with a circuit which provides a nonlinear difference term, i.e. $|V_A-V_B|$, and produces an output signal $V_O=K|V_AV_B|$ whenever the difference term is less than a given value which is greater than zero and produces an output signal $V_O=0$ whenever the difference term is less than the given value.

According to a further feature of the invention, in order to provide information with regard to the direction of the intrusion, the first and second electrical analog output signals are further processed to provide a pulse whenever a respective signal is present and the first appearing of these pulses is used to gate the output signal from the analog signal processing means to one of two alarm indicators, each of which is associated with one of said sense wires.

DETAILED DESCRIPTION OF THE PREFERRED EMBODIMENTS

Figure 1:
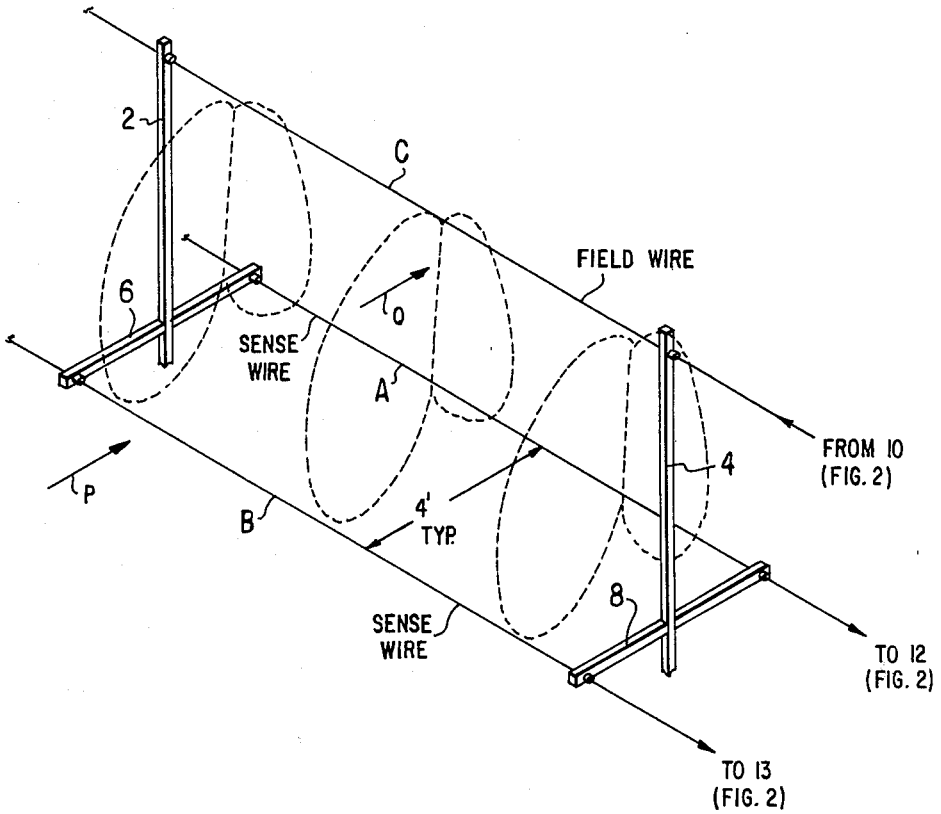
FIG. 1 is a schematic representation of a field and sense wire array according to the invention.

Turning now to FIG. 1, there is shown a basic arrangement of the antenna array for an intrusion warning system according to the invention. Although only one linear section of the array is shown in FIG. 1, it is to be understood that the array may comprise a plurality of such sections and extend around the entire perimeter of the area to be protected. As shown in FIG. 1, the antenna array comprises three parallel spaced electrically conductive wires A, B, and C. Each of the wires A, B, and C is mounted between support posts 2 and 4 in a manner so that they are all insulated from ground and from each other, by means of ceramic or glass insulators 5. As shown, the wire C is directly supported on the posts 2 and 4 whereas the wires A and B are mounted on the post 2 and 4 by means of cross bars 6 and 8 so that the wires A and B are vertically displaced and symmetrically disposed on opposite sides of and equidistantly spaced from the wire C, and so that the wires A and B are equidistantly spaced from ground. That is, the three wires A, B, and C form an isosceles triangle whose base AB is parallel to the ground. It should be noted that although wires A and B have been shown as being vertically disposed below the wire C, they may be disposed above same if desired. Typically, the distance between the wires A and B is in the order of 4 feet, the wires A and B are 10 inches above ground and the wire C is five feet above ground.

According to the present invention, the wire C is to function as a transmitting antenna or field wire, whereas, each of the wires A and B is to function as a receiving antenna or field sensing wire for sensing the common electric field produced by the field wire C. In general, the field wire C is connected to the output of an oscillator which produces a low frequency output signal whose wavelength is very long compared to the length of the field wire C in order to produce a desired alternating or quasi-stationary electric field. The frequency of this oscillator is, for example, in the range of from 1–40 KHz, and preferably in the range of from 2–20 KHz.

To detect the changes in the produced electric field caused by the disturbance of same by an intruder, and in particular the modulation of the amplitude of the electric field produced by the motion of an intruder within the electric field, a separate detecting circuit arrangement is connected to each of field wires A and B. Each of these detecting circuits, as will be explained below, produces a respective analog signal whose voltage output is proportional to the relative mass motion in the electric field.

With an array of wires, as is shown in FIG. 1, a person moving from a point P to a point Q would first disturb the electrical field as sensed by the wire B only, would then commonly disturb the fields as sensed by both the wires A and B, and would finally disturb the field as sensed by the wire A only. As the field in the zone monitored by each of the wires A and B is disturbed, the associated sensor circuit produces a respective analog voltage output that is proportional to the relative mass motion in the respective zone. By properly processing the respective two analog signals, it is possible to provide a single output signal which is indicative of the motion of an intruder within the area of interest and which yields substantial advantages over a system with only a single sense wire, and also to provide an indication of the direction of motion of the intruder.

According to the invention, the two analog signals $V_A$ and $V_B$ produced by the individual detecting circuits associated with the sensing wires A and B, respectively, are processed, using analog linear techniques, to produce a single output voltage $V_O=K(V_A)\ (V_B)\ (V_A-V_B)$ which is indicative of the motion of the intruder within the area of interest, and which is used to initiate an alarm or other indication. To determine the direction of the motion of the intruder, the one of the signals $V_A$ or $V_B$ which occurs first in time is utilized to gate the signal $V_O$ to a direction indicating alarm or other type indicator.

As indicated above, the intrusion warning system according to the present invention provides a number of advantages over a similar system utilizing only a single sense wire, and in particular, a basic immunity to false alarms caused by certain types of extraneous signals and/or objects. Initially, immunity against external interference signals, for example, stray field or transients, is provided in that since the two field sensing wires A and B are equally distant from ground, any such external interference signal coupling equally to both sense wires A and B, resulting in equal signals $V_A$ and $V_B$. With equal signals $V_A$ and $V_B$, the difference term $(V_A-V_B)$ becomes equal to zero, and the output signal $V_O$ likewise becomes equal to zero.

The use of the output voltage $V_O$ will likewise provide immunity to false alarms due to large moving objects adjacent to but not within the confines of the wire array of FIG. 1. That is, due to the product term $(V_A)\ (V_B)$, the output voltage $V_O$ will be zero, thus producing no alarm, unless a change in the electric field indicating mass motion is sensed by both sense wire A and sense wire B. Consequently, movement of objects adjacent only one of the sensing wires A or B, i.e. outside of the zone monitored by the other of the sensing wires, will remain undetected, i.e. will not produce an alarm. Accordingly, since detection will occur only within the area defined by the two sense wires A and B, movement of objects such as bushes, trees, etc. adjacent to the array will not produce an alarm.

The processed output signal $V_O$ according to the invention will likewise provide immunity against false alarms due to intrusion of small animals, for example of the size of a rabbit, since such animals will not disturb the field sensed by both sense wires A and B sufficiently at any point or time to cause signals of an alarm level.

Finally, the system according to the invention provides the advantage over a system utilizing only a single sense wire (in addition to being able to indicate the direction of intrusion) of increased sensitivity to attempts to crawl under or roll over the wire array. That is, from an examination of the processed output signal $V_O$, it is clear that this signal $V_O$ will pass through a maximum value when one of the voltages $V_A$ or $V_B$ is twice that of the other voltage, indicating that one of the sense wires A or B has detected a change twice that of the order. If we assume that the sense wire A has detected a change in field twice as large as that of the sense wire B, then $V_A$ will equal $2V_B$, and substituting this value into the equation for $V_O$ results in the equation $V_O=2V_B^3$. Obviously, at the point where this condition occurs, the system is much more sensitive to crawl under or roll over than a similar system utilizing only a single sense wire, for example as described in the above mentioned U.S. Pat. No. 4,064,499.

Figure 2:
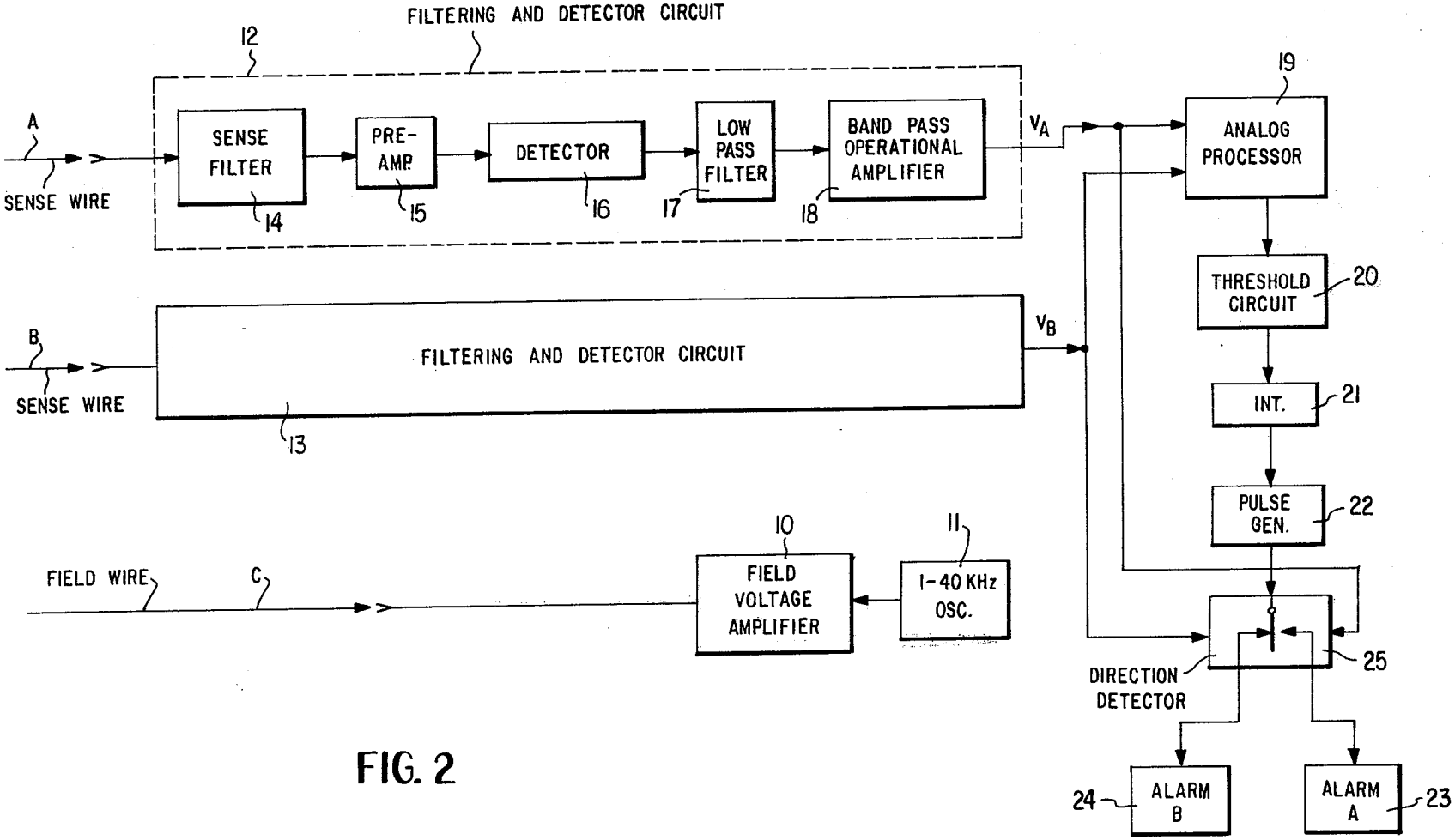
FIG. 2 is a block circuit diagram of an intrusion warning system according to the invention for use with the array of FIG. 1.

Turning now to FIG. 2, there is shown a block diagram of an embodiment of an intrusion warning system according to the invention for processing the signals originating from an array as shown in FIG. 1. In order to produce the desired quasi-stationary electric field, the field wire C is connected by an amplifier 10 to the output of a frequency controlled local oscillator 11, e.g., a crystal controlled oscillator, which produces a low frequency output signal whose wavelength is very long compared to length of the field wire C. As indicated above, the frequency of the oscillator 11 is, for example, in the range of from 1–40 KHz, and preferably in the range of from 2–20 KHz.

The field sensing wire A is connected to the input of a filtering and detecting circuit 12 at whose output appears the signal $V_A$, while the field sensing wire B is connected to the input of a signal filtering and detecting circuit 13, which is identical in construction to circuit 12, and at whose output appears the analog signal $V_B$. As shown, the input of the filtering and detecting circuit 12 comprises a sense filter 14 which, in general, comprises a resonant circuit tuned to the frequency of the oscillator 11. The output of the sense filter 14 is connected to the input of a preamplifier 15, which preferably provides bandpass shaping for the frequency of the oscillator 11 and has sufficient gain to properly drive the AM detector 16 connected to the output of the preamplifier 15. The AM detector 16 may be, for example, a single diode detector, but preferably is a synchronous detector.

The output signal from the AM detector 16 is passed, via a lowpass filter 17 having a cut-off frequency so that it will at least filter out signals of above about 20 Hz, to the input of a high gain operational amplifier 18 which is provided with a bandpass filtering arrangement so that the overall bandpass is in the order of about 0.1 to 2.5 Hz, which range is the low frequency component associated with the motion of an intruder and is the frequency component of interest. The filtered and amplified output signal of the operational amplifier 18 is the desired analog signal $V_A$. The circuit thus far described is substantially identical and functions in the same manner as the corresponding circuitry shown in the above-identified U.S. Pat. No. 4,064,499.

According to the present invention, the analog output signals $V_A$ and $V_B$ from the circuits 12 and 13, respectively, are fed to an analog processor 19 wherein the signals are combined and processed to provide the output signal $V_O=K\ (|V_A|)\ (|V_B|)\ (|V_A-V_B|)$ which signal is ultimately used to provide a signal for initiating an alarm. However, in order to insure that any such output signal $V_O$ was not produced by motion of a mass substantially smaller than that of a human body, for example, a small animal such as a rabbit, and to eliminate false alarms caused by short term transient responses, the output signal $V_O$ is fed to a standard voltage time comparator arrangement which will produce an output signal only if the input signal to same exceeds a predetermined or given threshold value for a given period of time. As shown, the voltage comparator circuit includes a threshold circuit 20, and includes circuit 21, and a one-shot pulse generator 22. In operation, whenever the signal $V_O$ produced by the analog processor 19 exceeds a predetermined threshold value, for example, ±2.6 V, the threshold circuit 20 will produce an output voltage or signal which is fed to the integrator which integrates same with respect to time. If the output signal from the threshold detector 20 persists for a predetermined period of time, which in the system according to the present invention is in the order of 400 milliseconds, the integrator 21 will provide an output voltage whose magnitude is sufficient to trigger the one-shot pulse generator 22 which will produce a single output pulse of a given duration, for example, 800 milliseconds, which is the actual signal used to control the alarm indicator.

In order to determine the direction of the intrusion, as indicated above, the system according to the invention is provided with two alarm circuits 23 and 24 which are associated with the sense wires A and B, respectively, and the output signal from the pulse generator 22 is connected to one or the other of these alarm circuits 23 and 24 via a direction detector circuit 25, which will be described more fully below. The control signals for the direction detector circuit 25 are provided by the output signals $V_A$ and $V_B$ from the circuits 12 and 13, respectively. In general, the direction detector circuit 25 determines which one of the signals $V_A$ or $V_B$ occurs first in time, and in response thereto connects the output to the pulse generator 22 to the appropriate alarm circuit 23 or 24 until such time as both output signals $V_A$ and $V_B$ are zero for a given period of time.

Figure 3:
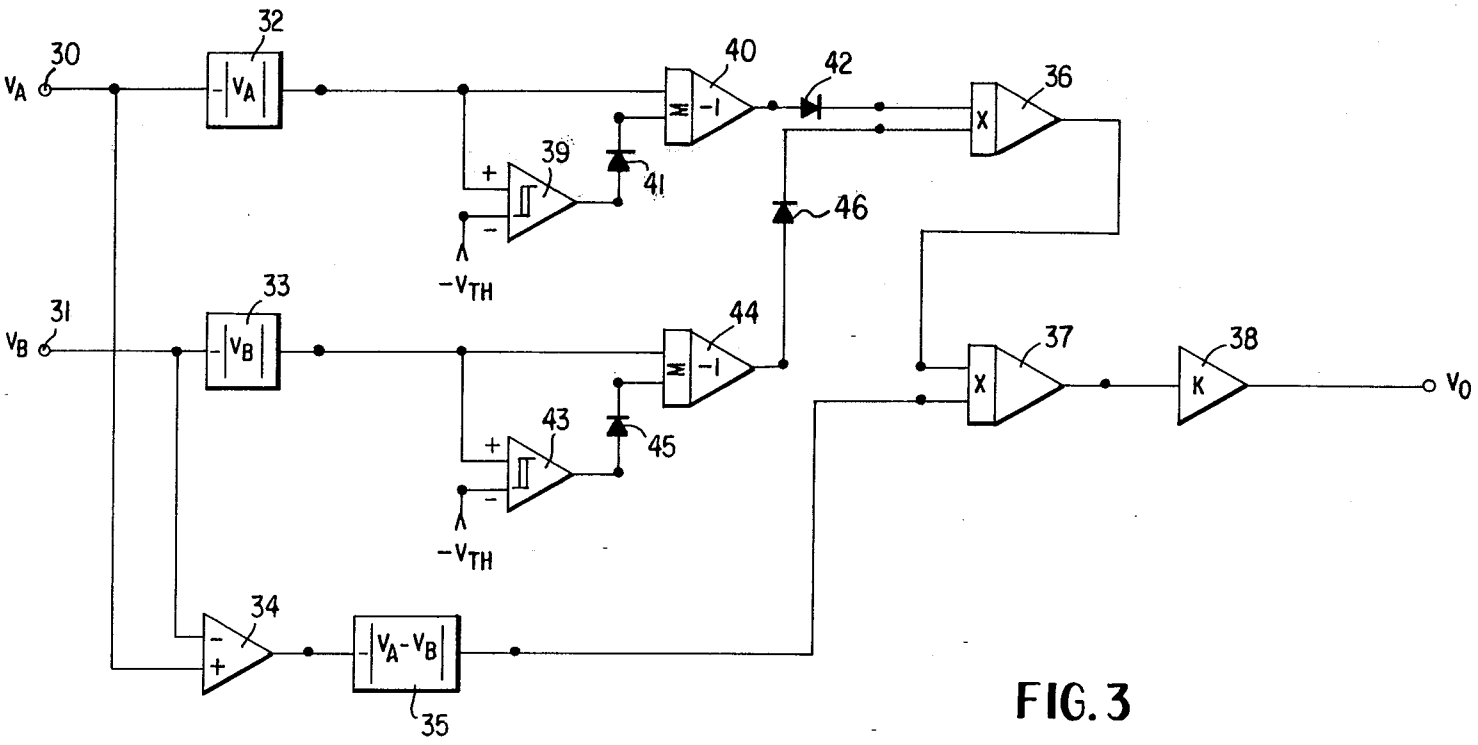
FIG. 3 is a block circuit diagram of one embodiment of the analog signal processor of FIG. 1.

Turning now to FIG. 3, there is shown the block circuit diagram for the basic embodiment of the analog signal processor 19 of FIG. 2. In general, in order to produce the desired output signal $V_O=K\ (|V_A|)\ (|V_B|)\ (|V_A-V_B|)$, the input terminals 30 and 31 for the analog signals $V_A$ and $V_B$, respectively, are connected to respective absolute value converters 32 and 33, and via a difference amplifier 34 to a further absolute value converter 35. The outputs of the absolute converters 32 and 33 are fed, via circuitry which will be explained further below, to respective inputs of a multiplier 36, while the output of the absolute value converter 35 is fed to one input of a further multiplier whose other input is connected to the output of the multiplier 36. The output of multiplier 37 is fed to an amplifier 38 with a gain equal to K at whose output the desired output signal $V_O$ appears.

As indicated above, the analog processing according to the invention utilizes the product terms of the two input signals to reduce nuisance alarms caused by motion adjacent only one of the sense wires A or B of the array. That is, in theory if mass motion occurs adjacent only one of the sensing wires A or B, the other sensing wire should not sense any change, i.e. the associated signal $V_A$ or $V_B$ should remain zero, and therefore $V_O$ should remain zero and no alarm should be produced. It has been found, however, that due to the loose field patterns, as a mass moves near one of the sense wires, the other sense wire detects this motion and produces a small signal. When this small signal is processed with the large signal from the sense wire on the side of the array where the motion occurred, the results can be a nuisance alarm. To eliminate this problem, and to further reduce nuisance alarms, the analog processor is provided with additional circuitry to produce a zero band. That is, additional circuitry is provided which maintains the inputs to the multiplier 36 at zero until such time as the signals $V_A$ and $V_B$ reach a predetermined threshold value, $V_{Th}$, e.g. 250 mv, at which time the input signals to the multiplier 36 snap to their actual value, the circuitry for producing this zero band is shown in FIG. 3 and comprises the Schmitt trigger 39, the inverting adder 40 and the two diodes 41 and 42 for the signal path for the voltage $V_A$, and the Schmitt trigger 43, the inverting adder 44 and the diodes 45 and 46 for the signal path for the analog voltage $V_B$.

With regard to the operation of the complete circuit of FIG. 3, the input signals $V_A$ and $V_B$ at the input terminals 30 and 31 are fed to the absolute value converters 32 and 33 at whose output there appears the signals $-|V_A|$ and $-|V_B|$, respectively. The output signal from the absolute value converter 32 is fed to one input of the inverting adder 40 and to the noninverting input of the Schmitt trigger 39 whose inverting input is connected to a negative source of threshold voltage $-V_{Th}$. In a similar manner, the output signal from absolute value converter 33 is fed to one input of the inverting adder 44 and to the noninverting input of the Scmitt trigger 43. As long as the signals at the respective noninverting inputs of the Schmitt triggers 39 and 43 remain below the threshold voltages, the outputs of the Schmitt triggers 39 and 43 remain in the high state and are fed through the associated diode 41 or 45 to the input of the respective inverting adder 40 or 44, forcing the respective adder output to a maximum negative value. This negative voltage value from the adder 40 will reverse bias the diode 42 while the similar negative voltage from the adder 44 will reverse bias the diode 46. Reverse biasing of either the diode 42 or the diode 46 will result in a zero voltage at the associated input of the multiplier 36, thus providing a zero output from same and for $V_O$. However, when the voltage at either the noninverting input of the Schmitt trigger 39 or the noninverting input of the Schmitt trigger 43 exceeds the associated threshold value, the output signal from the associated Schmitt trigger will shift to the low state. Under this condition, the associated diode 41 or 45 is reversed biased, so that the associated inverting adder 40 or 44 becomes in effect a unity again inverting amplifier with an output of $|V_A|$ or $|V_B|$. Such output signals will forward bias the respective diodes 42 and 46 and hence will be applied to the inputs of the multiplier 36 for further processing.

Although the presence of the difference term $(V_A-V_B)$ in the output signal $V_O$ of the analog processor 19 is desirable in order to eliminate false alarms due to external interferences which will effect both sense wires A and B equally, the removal of this linear difference term from the detection equation of the analog processor 19 would be desirable under certain conditions. For example, the removal of this linear difference term would increase the possibility of detection since when $V_A$ and $V_B$ have values which are close to each other, there would not be a fractional term to reduce the value of the overall output function as supplied to the threshold detector 20 of FIG. 2. Moreover, as can readily be appreciated, as the analog signals $V_A$ and $V_B$ become larger, the difference between same required in order to reach the threshold value of the threshold detector 20, and thus produce an alarm, become smaller, which is not desirable. Accordingly, in a preferred embodiment of the analog processor 19, the linear difference term $(V_A-V_B)$, is replaced by a nonlinear difference term which functions as shown in the graph of FIG. 4 wherein the actual value of $V_A-V_B$ is shown as the abscissa and the nonlinear value produced in the analog processor 19 is shown as the ordinate.

Figure 4:
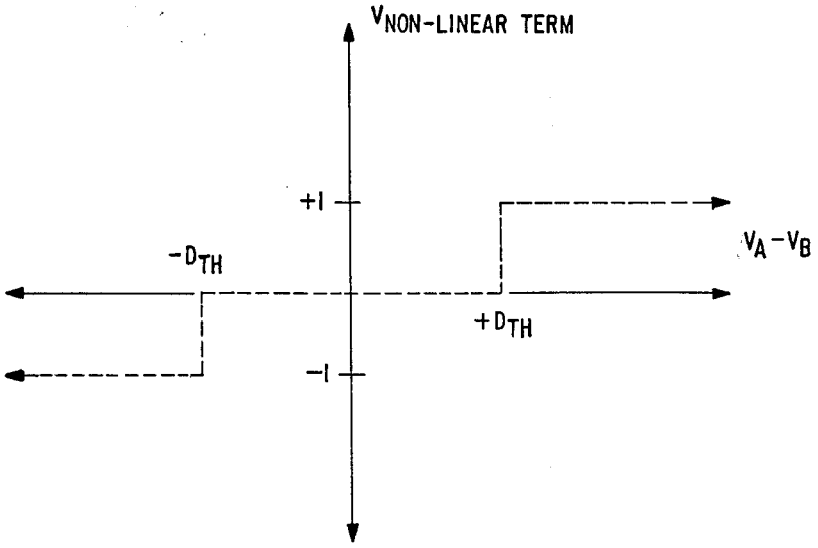
FIG. 4 is a graph illustrating a preferred non-linear difference function for the analog processing.

As can been seen from the graph of FIG. 4, at any time that the difference between $V_A$ and $V_B$ is less than a predetermined difference threshold $\pm D_{Th}$, the nonlinear difference term produced in the analog processor will be zero which will cause the entire detection equation of $V_O$ to become zero. Alternatively, at any time that the difference between $V_A$ and $V_B$ is greater than $|D_{Th}|$, the nonlinear difference term produced in the analog processor will be unity, i.e. equal to one. Under this condition, the detection equation becomes $V_O=K(|V_A|)(|V_B|)$. Due to this nonlinear difference term, the previously mentioned advantage of increased crawl under protection, stemming from $V_O=2\ V_B^3$, must be modified to $V_O=K2\ V_B^2$. Although this reduces crawl under sensitivity, the $V_B^2$ term is not only suffient but still a major advantage over non-processed systems.

Figure 5:
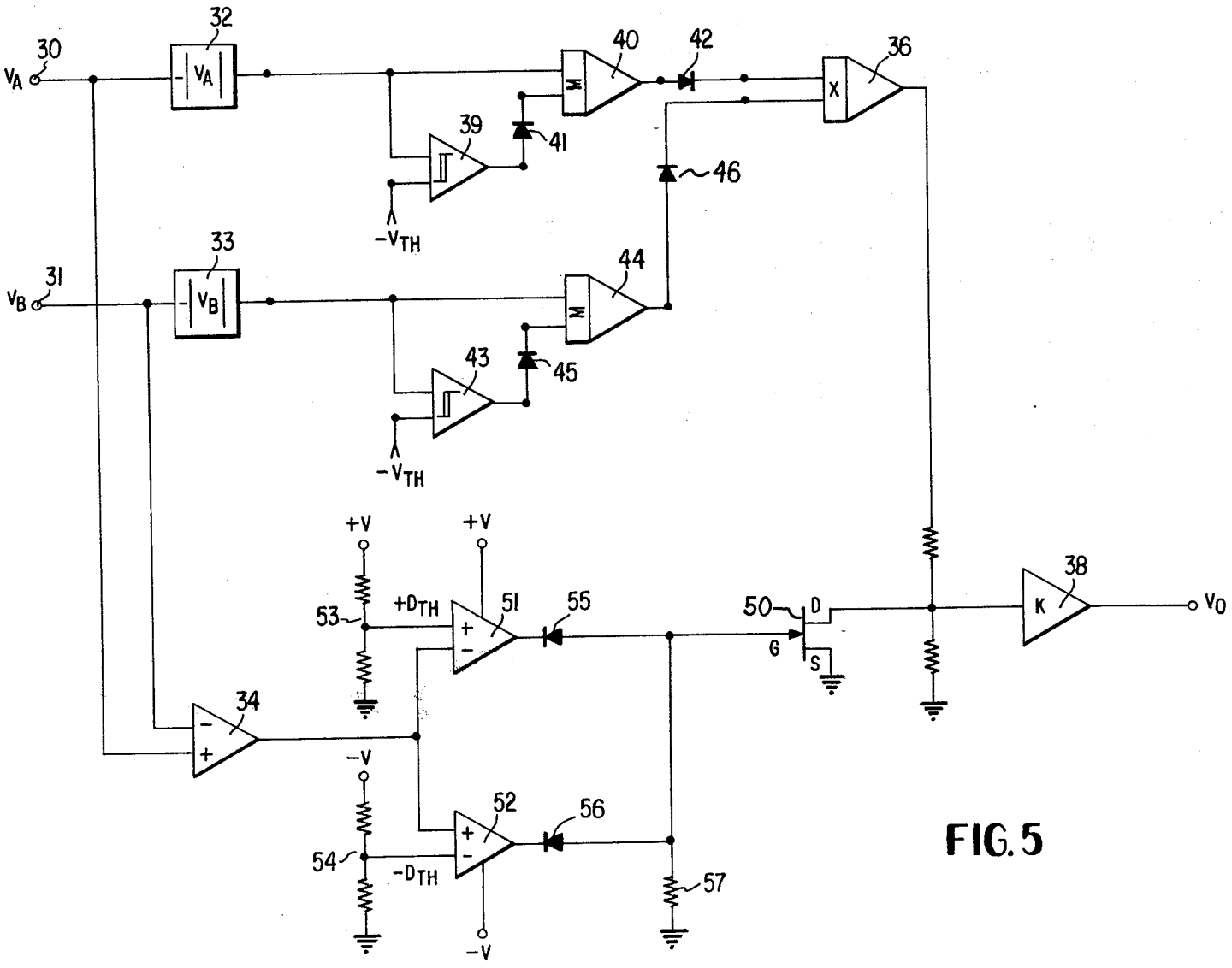
FIG. 5 is a block circuit diagram showing a modified preferred embodiment of the analog signal processor of FIG. 1 including the non-linear difference term of FIG. 4.

Turning now to FIG. 5, there is shown an analog processor according to FIG. 3 which has been modified in order to provide the nonlinear difference term illustrated graphically in FIG. 4. In this Figure, parts which are the same as those shown in FIG. 3 are indicated by the same reference numeral. As can be clearly seen, the signal paths between the input terminals 30 and 31 and the output of multiplier 36 are identical to that shown in FIG. 3. However, the output of the multiplier 36 is now directly connected to the input of the amplifier 38 and to the drain D of a field effect transistor 50 whose source is connected to ground.

In order to form the nonlinear difference function, the output of the difference amplifier 34 is connected to a threshold detector for determining whether or not the linear difference signal $(V_A-V_B)$ produced by the amplifier 34 is above or below the desired difference threshold $\pm D_{Th}$. Specifically, the output signal from the amplifier 34 is connected to the inverting input of a difference amplifier 51 and to the noninverting input of a further difference amplifier 52. The noninverting input of the difference amplifier 51 is connected to the tap of a voltage divider 53 which is dimensioned so that the voltage at the tap is equal to the desired positive threshold value $+D_{Th}$, e.g. 500 mv. In a similar manner, the inverting input of the amplifier 52 receives a value equal to the desire negative threshold value $-D_{Th}$ from the center tap of a voltage divider 54. The outputs of the amplifiers 51 and 52 are connected via respective diodes 55 and 56 to the gate G of the field effect transistor 50 and via a resistor 57 to ground. In operation of the circuit of FIG. 5, whenever the absolute value of the linear difference signal at the output of the amplifier 34 is less than the threshold value $D_{Th}$, the field effect transistor 50 will be rendered conductive, causing the output of the multiplier 36 to be connected to ground and the output signal $V_O$ to be zero. Alternatively, whenever the absolute value of the output signal from the amplifier 34 is greater than the threshold value $D_{Th}$, one of the amplifiers 51 or 52 will produce an output signal which will cause the field effect transistor 50 to be blocked, thus causing the output signal from the multiplier 36 to be directly fed to the amplifier 38, i.e., in effect multiplying the product signal at the output of multiplier 36 by unity or one.

Figure 6:
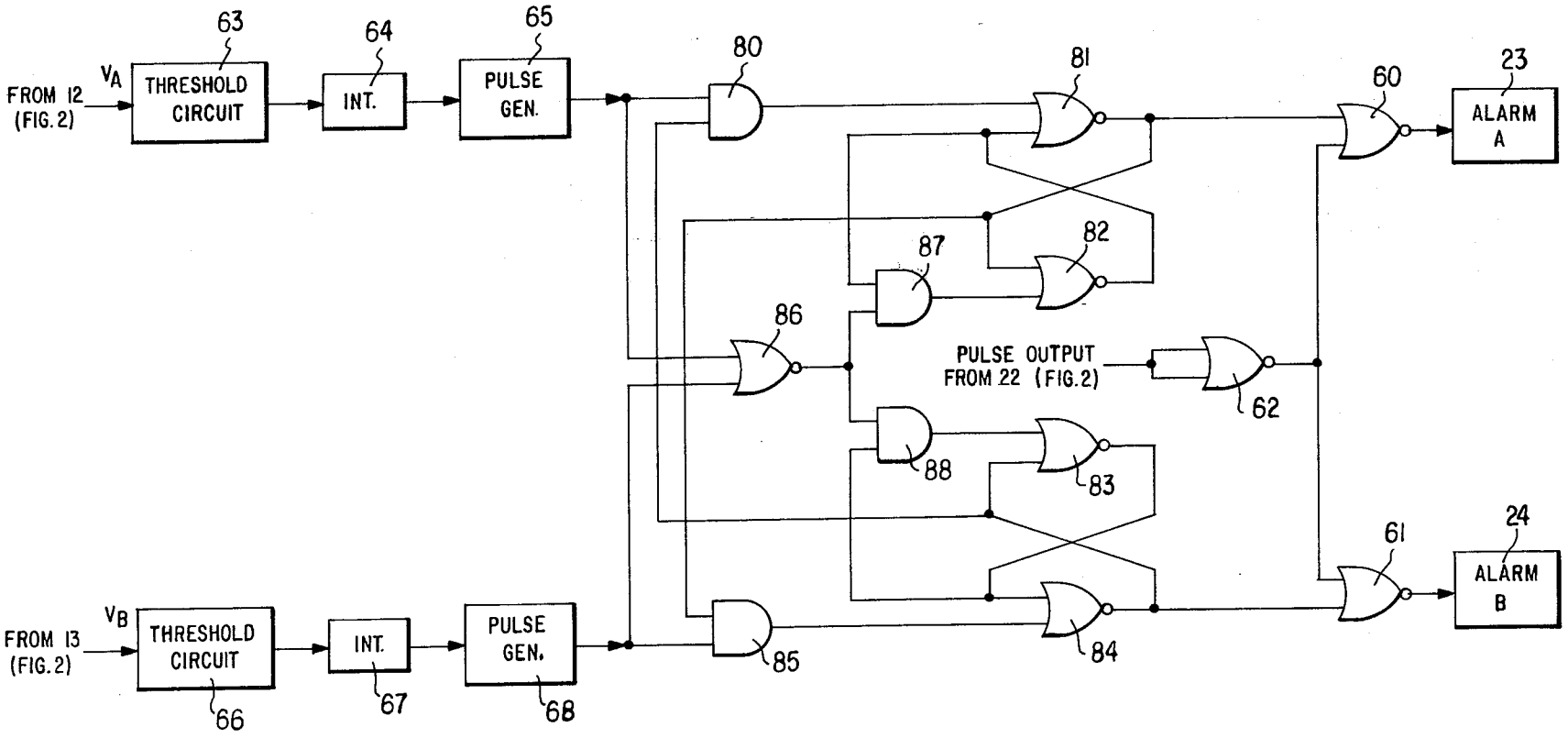
FIG. 6 is a logic circuit diagram of one embodiment of the direction control circuit of FIG. 2.

Turning now to FIG. 6, there is shown one embodiment of an arrangement for the direction detector circuit 25 of FIG. 2. As shown, the alarm circuits 23 and 24 are connected to the outputs of respective NOR gates 60 and 61, each of which has one input connected to the output of a further NOR gate 62, whose inputs are connected together and to the output of the pulse generator 22 of FIG. 2. With this arrangement, depending on which of the NOR gates 60 or 61 is enabled by an appropriate signal on its other input, the output pulse from the pulse generator 22 will pass to the appropriate alarm 23 or 24 to energize same for the duration of the output pulse from pulse generator 22, i.e. 800 milliseconds as mentioned above. As further mentioned above, the one of the alarms 23 or 24 which is energized to produce the alarm, is determined by which one of the output signals $V_A$ and $V_B$ from the circuits 12 and 13, respectively, occurs first in time, and of course is representative of an intrusion rather than a short term transient. it is further desirable that the output pulses from the pulse generator 22 be directed to the same alarm circuit 23 or 24 for the entire duration of an intruder within the area covered by the array of FIG. 1, in order to insure that the one of the alarm circuits 23 or 24 producing an alarm indicates the direction from which the intrusion originally occurred.

To provide a direction detecting circuit 25 which performs the above functions, the output signal $V_A$ from the circuit 12 is fed to a threshold detector 63 which produces an output voltage whenever the absolute value of the voltage $V_A$ exceeds a given threshold value. The output signal from the threshold detector 63 is fed to an integrating or ramp circuit 64 which integrates same to produce a ramp voltage of a given polarity. If the output signal from the threshold detector 63 persists for a given period of time, the ramp voltage 64 will reach a threshold value sufficient to trigger the one shot pulse generator 65 connected to the output of the integrator 64, causing the plate generator 65 to produce an output pulse. A circuit generally operating in this manner is disclosed in the above-identified Geiszler et al U.S. Pat. No. 4,064,499. The output signal $V_B$ from the circuit 13 of FIG. 2 is fed to a threshold detector 66, an integrator 67, and a pulse generator 68 which are identical to and function in the same manner as the corresponding circuits 63–65.

Since the output pulses from the pulse generators 65 and 66 are used simply for gating purposes, and in order to insure that at least one of the pulse generators 65 or 68 is producing such a gating pulse at any time that an output pulse indicating an alarm is being produced by the pulse generator 22 and fed to the NOR gate 62, the threshold values for the threshold detectors 63 and 66, and the time required for the ramp voltages of the integrating circuits 64 and 67 to reach the threshold values required to trigger the pulse generators 65 and 68, are set at low values relative to the corresponding threshold and integration values utilized to produce the alarm signal from the pulse generator 22. For example, the threshold values of the detectors 63 and 66 are set at 600 mv and the integration time of the integrators 64 and 67 is set at 40 milliseconds. Additionally, to insure that the pulse generators 65 and 68 will produce an output pulse during the entire period that the motion of the intruder is being detected by their respective sense wires A and B, the pulse generators 65 and 68 produce output pulses of a relatively long pulse duration, for example 5 seconds, and each of the one-shot pulse generators 65 and 68 is modified so that it is retriggerable. That is, the one-shot pulse generators 65 and 68 are modified so that as long as the output voltage from the associated integrator 64 or 67 is above the threshold value required to trigger the pulse generator 65 or 68, or if the output voltage from the associated integrator 64 or 67 should again reach the threshold value required to trigger the pulse generator 65 or 68, the output pulse from the respective pulse generator will be extended for an additional pulse duration, i.e. 5 seconds in the given example.

Figure 7:
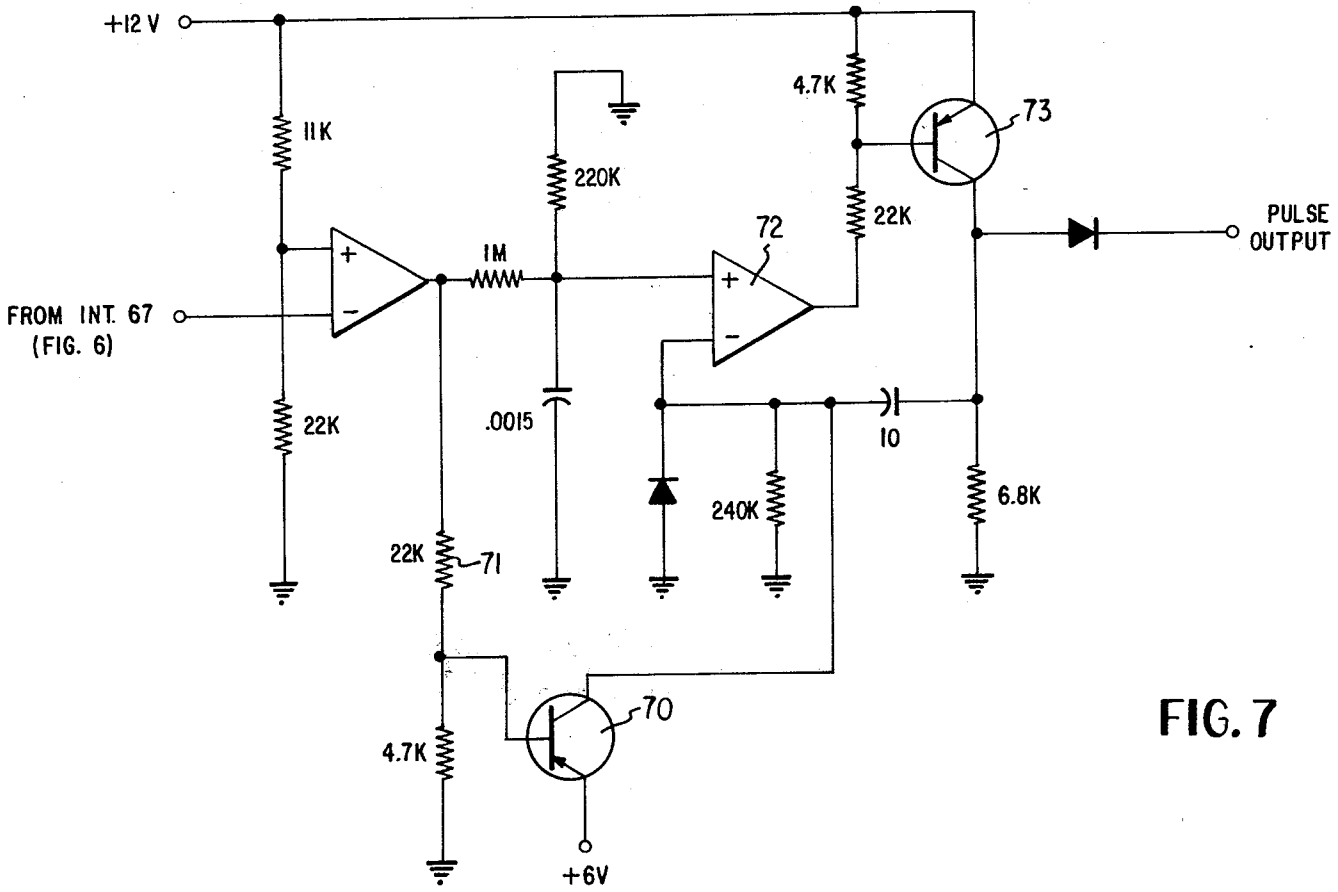
FIG. 7 is a circuit diagram of the retriggerable pulse generator of FIG. 6.

The manner in which the pulse generator 65 and 68 are made retriggerable is shown in FIG. 7 which, except for the transistor 70 and the voltage divider 71 shows a conventional one-shot pulse generator. Due to the transistor 70, and the voltage divider 71, which is connected to the input of the pulse generator, at any time that the input voltage is above the threshold value for the one-shot, the transistor 70 will be conductive, thus connecting the inverting input of the differential amplifier 72 to the six volt supply source, and preventing the amplifier 72 from turning off the transistor 73. A similar result will occur if an input signal above the threshold value for the one-shot pulse generator should reappear at any time during the normal 5 second pulse duration. Consequently, the output signal from the pulse generator will persist until such time as the input signal to same falls below the threshold value for a period of 5 seconds.

Returning now to FIG. 6, the outputs from the pulse generators 65 and 68 are fed to the inputs of a logic switching network including a plurality of interconnected AND and NOR gates, which, in response to the output signal from the one of the pulse generators 65 and 68 occurring first in time, enables the associated NOR gate 60 or 61, and prevents the enablement of the other NOR gate 60 or 61 until such time as neither pulse generator 64 or 66 is producing an output pulse. In view of the nature of the pulse generator 65 and 68 as explained above, such will occur only when neither integrating circuits 64 or 67 has produced an output signal equal to the threshold of the pulse generator 65 and 68 for a period of 5 seconds.

As shown in FIG. 6, the output of the pulse generator 65 is connected to one input of an AND gate 80 whose output is connected to and enables a latch circuit, including interconnected NOR gates 81 and 82, whose output is connected to an enables the NOR gate 60. The other input of the AND gate 80 is connected to a similar latch circuit 83, 84 associated with the input AND gate 85 for the output signal from the pulse generator 68. The outputs from the pulse generators 65 and 68 are likewise connected to the inputs of a further NOR gate 86 whose output controls the reset AND gates 87 and 88 for their respective latches 81,82 and 83,84.

In operation, when the system is at rest, i.e. neither pulse generator 65 or 68 is producing an output pulse, both latches 81, 82 and 83,84 are in their normal position and each of the input AND gates 80 and 85 is enabled. If, for example, the pulse generator 65 should be fired, its output will be passed through the enabled AND gate 80 to set the latch 81,82 and enable the NOR gate 60 to energize the alarm circuit 23 upon receipt of an alarm pulse from the NOR gate 62. Setting of the latch 81, 82 disables the input AND gate 85, thus preventing setting of the latch 83, 84 and the enabling of NOR gate 61. Setting of the latch 81, 82, likewise enables the reset AND gate 87 of the set latch 81, 82. The circuit will remain in this condition until such time as neither pulse generator 65 or 68 is producing an output signal. At such time, the absence of an output signal on either of the two inputs will be detected by the NOR gate 86 and its output used to cause the AND gate 87 to reset the latch 81, 82 and return the entire logic system to its nonactive or normal state. In a similar manner, if the pulse generator 68 produces an output pulse prior to the pulse generator 65, the latch 83, 84 will be set via the AND 85 to enable the NOR gate 61, and the input AND gate 80 will be blocked.

It will be understood that the above description of the present invention is susceptible to various modifications, changes and adaptations, and the same are intended to be comprehended within the meaning and range of equivalents of the appended claims.

What is claimed is:

1. An intrusion warning system for protecting at least a portion of the perimeter of a given area comprising in combination:

means for producing a quasi-stationary electric field including a field wire insulated from ground and extending along the portion of the perimeter to be protected substantially parallel to ground, and an oscillator circuit having its output connected to said field wire and producing an output signal whose wavelength is very long compared to the length of said field wire;

first and second field sensing wires insulated from ground and extending along said portion of the perimeter substantially parallel to and vertically displaced from said field wire, said field sensing wires being disposed on opposite sides of said field wire and equidistantly spaced from said field wire and from ground;

first and second detector means, connected to said first and second sensing wires respectively, for detecting changes in the electric field sensed by said sense wires and for producing respective first and second electrical analog output signals corresponding to said changes;

signal processing means for combining and multiplying said first and second electrical analog output signals and for producing an output signal whenever neither of said first and second electrical analog output signals is equal to zero and the difference between said first and second analog output signals is greater than a given value; and alarm circuit means responsive to an output signal from said signal processing means for producing an alarm.

2. An intrusion warning system as defined in claim 1 wherein said signal processing means produces an output signal $$Vo=K\,(|V_A|)\,(|V_B|)\,(|V_A-V_B|)$$

wherein

K is a variable gain constant;

$V_A$ is said first analog electrical output signal;

$V_B$ is said second analog electrical output signal.

3. An intrusion warning system as defined in claim 2 wherein said signal processing means includes first and second input terminals connected to the outputs of said first and second detector means respectively;

a first signal multiplier having first and second inputs and an output;

first absolute value means connected between said first input terminal and said first input of said first signal multiplier for forming the absolute value of said input signal $V_A$;

second absolute value means connected between said second input terminal and said second input of said first signal multiplier for forming the absolute value of input signal $V_B$;

a second signal multiplier having a first input connected to said output of said first signal multiplier, and its output connected via an amplifier with a gain of said constant K to the output of said signal processing means; and circuit means having its output connected to a second input of said second signal multiplier and including the series connection of a difference amplifier having first and second inputs connected to said first and second input terminals respectively, for forming the difference signal $V_A-V_B$, and third absolute value means for forming the absolute value of said difference signal.

4. An intrusion warning system as defined in claim 1 wherein said signal processing means produces an output signal $$Vo=K\,|V_AV_B|$$

whenever $|V_A-V_B|$ is greater than said given value, wherein

K is a variable gain constant $V_A$ is said first analog electrical output signal; and $V_B$ is said second analog electrical output signal.

5. An intrusion warning system as defined in claim 4 wherein said signal processing means includes:

first and second input terminals connected to the outputs of said first and second detector means respectively;

a signal multiplier having first and second inputs and an output;

a first signal path connected between said first input terminal and said first input of said signal multiplier and including means for forming the absolute value of said input signal $V_A$;

a second signal path connected between said second input terminal and said second input of said signal multiplier and including means for forming the absolute value of said input signal $V_B$;

a third signal path including a difference amplifier means, having inputs connected to said first and second input terminals and having an output, for producing a signal corresponding to the difference between said signals $V_A$ and $V_B$, a field effect transistor having a gate and having its source-to-drain path connected between ground and said output of said signal multiplier, and circuit means connected between said output of said difference amplifier means and said gate of said field effect transistor for rendering said field effect transistor conductive only when the absolute value of said signal corresponding to the difference between said signals $V_A$ and $V_B$ is less than said given value; and an amplifier with a gain of said constant value K connected between said output of said signal multiplier and the output of said signal processing means.

6. An intrusion warning system as defined in claim 5 wherein said circuit means connected to the output of said difference amplifier means includes:

a first operational amplifier, having its inverting input connected to the output of said differential amplifier means, its noninverting input connected to a positive reference voltage of said given value, and its output connected to said gate of said field effect transistor via a diode;

a second operational amplifier having its noninverting input connected to said output of said differential amplifier means, its inverting input connected to a negative reference voltage of said given value, and its output connected to said gate of said field effect transistor via a diode;

a resistor connecting said gate of said field effect transistor to ground.

7. An intrusion warning system as defined in claim 5 wherein each of said first and second signal paths further includes:

an inverting adder circuit having one input connected to the output of the associated means for forming the absolute value, its other input connected to the output of an associated Schmitt trigger via a diode and its output connected via a further diode to the associated input of said signal multiplier, means connecting the output of the associated means for forming the absolute value to the noninverting input of the associated Schmitt trigger; and means connecting the inverting input of the associated Schmitt trigger to a negative reference value.

8. An intrusion warning system as defined in claim 1 further including first and second persistence circuit means responsive to said first and second electrical analog output signals respectively, for producing a respective output signal whenever the associated said first or second electrical analog output signal persists for a predetermined period of time; and wherein said alarm circuit means includes:

output pulse means responsive to said output signal from said signal processing means for producing an output pulse of a fixed duration whenever said output signal from said signal processing means exceeds a given threshold value and persists for a given period of time;

first and second alarms, one associated with each of said first and second sensing wires; and direction detection circuit means responsive to the first arriving one of said output signals from said first and second persistence circuit means for connecting said output pulse from said output pulse means to the one of said first and second alarms associated with said first arriving one of said output signals to energize said one of said alarms, and for blocking energization of the other of said alarms thereby providing an indication of the one of said sensing wires first sensing a change in said field and hence the direction of the intrusion.

9. An intrusion warning system as defined in claim 1, 2 or 4 wherein said frequency of said oscillator circuit is in the range of 1–40 kHz; and each said first and second detector means includes an AM detector, and a band pass amplifier means for amplifying the output signal from said AM detector and passing only the low frequency component of from 0.1 to 2.5 Hz.

* * * * *